US010295924B2

(12) United States Patent
Araki

(10) Patent No.: US 10,295,924 B2
(45) Date of Patent: May 21, 2019

(54) IMAGE FORMING APPARATUS HAVING CONTROLLER FOR SWITCHING THRESHOLDS FOR DECIDING AMOUNT OF COLOR MISREGISTRATION

(71) Applicant: CANON KABUSHIKI KAISHA, Tokyo (JP)

(72) Inventor: Ryuichi Araki, Matsudo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/009,837

(22) Filed: Jun. 15, 2018

(65) Prior Publication Data

US 2019/0011868 A1 Jan. 10, 2019

(30) Foreign Application Priority Data

Jul. 4, 2017 (JP) ..... 2017-131192

(51) Int. Cl.
*G03G 15/01* (2006.01)
*G03G 15/00* (2006.01)

(52) U.S. Cl.
CPC ..... *G03G 15/0178* (2013.01); *G03G 15/0189* (2013.01); *G03G 15/5058* (2013.01); *G03G 2215/0158* (2013.01)

(58) Field of Classification Search
CPC ..... G03G 15/0131; G03G 15/0178; G03G 15/0189; G03G 15/5058; G03G 15/01; G03G 2215/0158
USPC ..... 399/39, 40, 49, 301; 347/116
See application file for complete search history.

(56) References Cited

U.S. PATENT DOCUMENTS 8,995,892 B2 * 3/2015 Sato ..... G03G 15/50 399/301
9,651,908 B2 * 5/2017 Nagashima ..... G03G 15/5054
2010/0172662 A1 * 7/2010 Ogawa ..... G03G 15/0131 399/39
2013/0302050 A1 * 11/2013 Shimba ..... G03G 15/0189 399/49

(Continued)

FOREIGN PATENT DOCUMENTS

JP 2010117735 A * 5/2010
JP 2010224009 A * 10/2010 ..... G03G 15/0131
JP 2013025184 A 2/2013

*Primary Examiner* — Robert B Beatty
(74) *Attorney, Agent, or Firm* — Rossi, Kimms & McDowell LLP

(57) ABSTRACT

An image forming apparatus is capable of switching thresholds for deciding a color registration amount from a pattern image. A controller controls image forming units to form first and second color patterns of different colors on a rotational image bearing member. The second color pattern is formed at an upstream side of the first color pattern in a rotational direction of the image bearing member. The controller controls a sensor to detect the color patterns. A comparator compares a detection result by the sensor with a threshold, and outputs an output value according to a comparison result. The controller controls the color registration according to the output value. The controller sets a second threshold for the second color pattern based on an edge timing of the output value from the comparator according to the comparison result between the detection result about the first color pattern and a first threshold.

15 Claims, 10 Drawing Sheets

(56) References Cited

U.S. PATENT DOCUMENTS

| | | | | |
|---|---|---|---|---|
| 2015/0277268 | A1* | 10/2015 | Goto | G03G 15/043<br>399/301 |
| 2017/0235266 | A1* | 8/2017 | Ino | G03G 15/0131<br>399/301 |
| 2017/0329267 | A1* | 11/2017 | Yamazaki | G03G 15/5054 |
| 2017/0336737 | A1* | 11/2017 | Takahashi | G03G 15/5058 |

* cited by examiner

IMAGE FORMING APPARATUS HAVING CONTROLLER FOR SWITCHING THRESHOLDS FOR DECIDING AMOUNT OF COLOR MISREGISTRATION

BACKGROUND OF THE INVENTION

Field of the Invention

The present invention relates to an image forming apparatus that forms a color image.

Description of the Related Art

An image forming apparatus of an electrophotographic system that forms a color image is known conventionally. For example, there is a tandem-system apparatus that forms an image through an electrophotography process including electrification, exposure, development, and transfer about each of colors of yellow (Y), magenta (M), cyan (C), and black (K) and obtains a color image by overlapping the images of the respective colors. Such an apparatus is required to control a sheet conveyance timing and an image formation timing correctly in order to reduce color registration. Accordingly, the apparatus forms a pattern image that consists of patterns (toner images) of the respective colors for detecting color registration on an image bearing member, such as an intermediate transfer belt, detects this pattern image by an optical sensor, calculates color-registration amounts between the respective colors on the basis of the detected results, and corrects the color registration.

FIG. 12A and FIG. 12D are views showing patterns for detecting color registration formed on the intermediate transfer belt viewed in a horizontal direction. FIG. 12B and FIG. 12E are views respectively showing output signals (sensor outputs) of a color registration sensor when reading the patterns in FIG. 12A and FIG. 12D. FIG. 12C and FIG. 12F are views respectively showing binary signals a, b, and c that are obtained by binarizing the sensor outputs shown in FIG. 12B and FIG. 12E with thresholds a, b, and c. The sensor output is binarized and a midpoint between a rising edge and falling edge of the binarized waveform is obtained as a pattern position. When the pattern with uniform density (toner amount) as shown in FIG. 12A is read, the sensor output exhibits a symmetrical waveform as shown in FIG. 12B. When the threshold for binarizing this waveform is changed to 75% (threshold a), 50% (threshold b), and 25% (threshold b) of the signal amplitude of the sensor output, the binarized waveform varies as the binary signals a, b, and c, respectively (FIG. 12C). The pattern positions reg_a, reg_b, and reg_c that are found from these binary signals a, b, and c are almost identical (FIG. 12C). When the waveform of the sensor output is symmetrical like this, the pattern position calculated does not change even if the threshold is changed.

In the meantime, when the density (toner amount) is uneven as shown in FIG. 12D, the sensor output exhibits an asymmetrical waveform as shown in FIG. 12E. In this case, the pattern positions reg_a, reg_b, and reg_c that are found from the binary signals a, b, and c binarized with the thresholds a, b, and c are mutually different (FIG. 12F). When the waveform of the sensor output is asymmetrical, a detection result of the pattern position varies according to the threshold used for binarizing the sensor output waveform.

In order to solve such a problem, Japanese Laid-Open Patent Publication (Kokai) No. 2013-25184 (JP 2013-25184A) suggests a technique for reducing a detection error by matching a waveform width of a square wave that is obtained by binarizing a sensor output by changing a threshold for binarization even if the sensor output waveform becomes asymmetrical due to occurrence of optical-axis deviation in a reflection optical sensor.

However, when the threshold is changed according to the waveform width of the square wave like the above-mentioned publication, it is necessary to switch the thresholds whenever detecting yellow, magenta, cyan, and black patterns.

FIG. 4A and FIG. 4B respectively show a pattern image PT1 for detecting color registration and a binary signal that is obtained by binarizing the detection signal that the color registration sensor reads. FIG. 4C shows switching timings of the threshold. The pattern image PT1 consists of yellow patterns 801 and 811, magenta patterns 802 and 812, cyan patterns 803 and 813, and black patterns 804 and 814. A moving direction of an intermediate transfer belt on which the pattern image PT1 is formed is a subscanning direction. The direction (belt-width direction) that intersects perpendicularly with the subscanning direction is a main scanning direction. A pattern of each color is inclined at 45 degrees to the main scanning direction. An inclination direction of the patterns 801 through 804 is opposite to an inclination direction of the patterns 811 through 814.

A broken line shown in FIG. 4B shows a center position between a rising edge and falling edge of the binary signal. Time periods ym_1, yc_1, and yk_1 are values into which distances from the center position of the yellow pattern 801 as the standard color to the center positions of the other color patterns 802, 803, and 804 are converted. Similarly, time periods ym_2, yc_2, and yk_2 are values into which distances from the center position of the yellow pattern 811 to the center positions of the other color patterns 812, 813, and 814 are converted. A color registration amount is calculated on the basis of these time periods.

As shown in FIG. 4C, a predetermined period A from a timing at which image formation starts to a timing at which the sensor detects a pattern can be beforehand found on the basis of distance of an image conveyance range from an exposure position as an image formation start position to a sensor position and a conveyance speed. Moreover, predetermined periods B and C that are equivalent to intervals between formations of adjacent patterns can be beforehand found from a design specification. The threshold will be switched from the value for yellow to the value for magenta when the predetermined period A elapses. After that, the threshold will be switched to the value for cyan and the value for black in order when the predetermined periods B and C elapse.

The predetermined periods A, B, and C are so set up that the threshold is switched between adjacent patterns as shown in a case A. However, the formation positions of the patterns may shift due to deviations of exposure positions accompanying a temperature rise as shown in a case B, and the timings at which the formed patterns are conveyed to the detection position of the sensor may vary due to unevenness of a conveyance speed. In such cases, if the predetermined periods A, B, and C are fixed, switching to the threshold for the following pattern may become too late or too early. When a timing at which a pattern is conveyed shifts ahead or behind a switching timing of the thresholds, the binarization using the suitable threshold becomes impossible and a detection position of a pattern will become inaccurate.

Since the period for calculating color registration is downtime for a user, the period should be as short as possible. Accordingly, the length of the pattern image PT1 in the subscanning direction should be as short as possible, and the interval of the color patterns tends to be designed as short as possible. In such a situation, it becomes more important to adjust the switching timing of the threshold correctly according to variation of a pattern formation position or a conveyance speed.

SUMMARY OF THE INVENTION

The present invention provides an image forming apparatus that is capable of switching thresholds for deciding a color registration amount from a pattern image at a suitable timing.

Accordingly, a first aspect of the present invention provides an image forming apparatus that forms an image on a sheet comprising an image bearing member configured to rotate, a plurality of image forming units configured to form color images, each having a different color, on the image bearing member, a sensor configured to detect color patterns formed on the image bearing member by the plurality of image forming units, the color patterns being used for detecting color registration, a comparator configured to compare a detection value corresponding to a detection result by the sensor with a threshold, and to output an output value according to a comparison result, and a controller configured to control the plurality of image forming units to form color patterns, to control the sensor to detect the color patterns, to set the thresholds that correspond to the color patterns, to control the color registration according to the output value from the comparator. The color patterns include a first color pattern of first color and a second color pattern of second color that is different from the first color. The second color pattern is formed at an upstream side of the first color pattern in a rotational direction of the image bearing member. The first color pattern is adjacent to the second color pattern. The controller sets the threshold to a second threshold that corresponds to the second color pattern based on an edge timing of the output value that is output from the comparator according to the comparison result between the detection value corresponding to a detection result about the first color pattern and a first threshold corresponding to the first color pattern.

According to the present invention, the thresholds for deciding the color registration amount from the pattern image are switched at a suitable timing.

Further features of the present invention will become apparent from the following description of exemplary embodiments with reference to the attached drawings.

DESCRIPTION OF THE EMBODIMENTS

Hereafter, embodiments according to the present invention will be described in detail with reference to the drawings.

Figure 1:
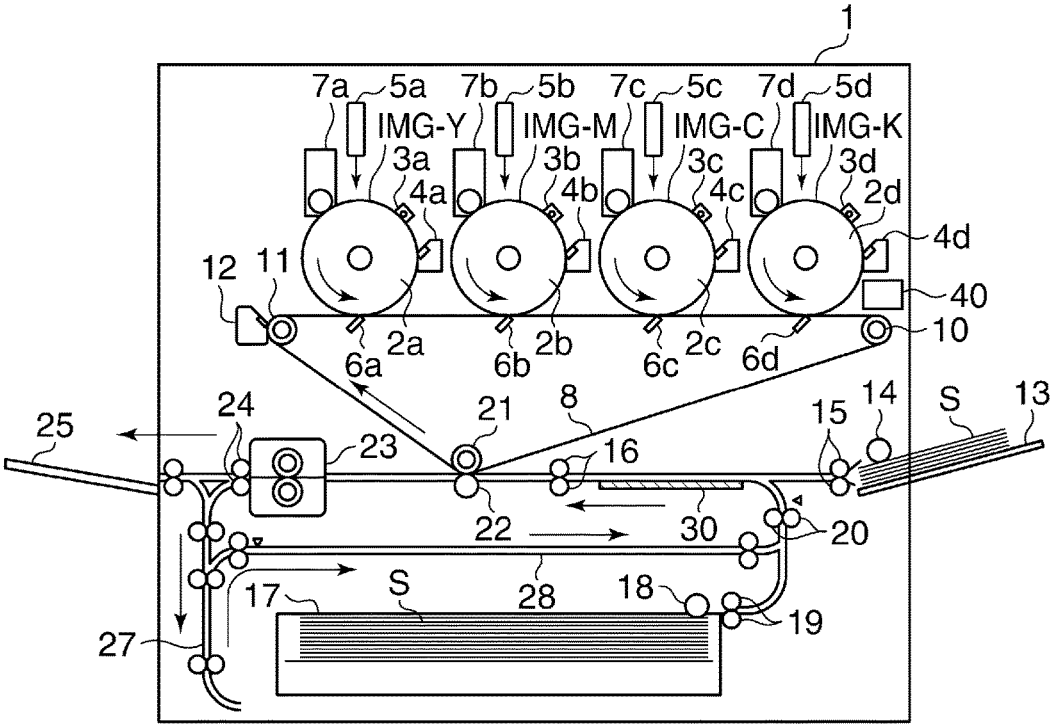
FIG. 1 is a sectional view schematically showing an image forming apparatus according to a first embodiment of the present invention.

FIG. 1 is a sectional view schematically showing an image forming apparatus according to a first embodiment of the present invention. The image forming apparatus 1 has four stations IMG-Y, IMG-M, IMG-C, and IMG-K as image forming units for forming images of a plurality of colors (four colors) including yellow (Y), magenta (M), cyan (C), and black (K). Components of each station are common. The image forming apparatus 1 has photosensitive drums 2*a*, 2*b*, 2*c*, and 2*d*. Electrostatic chargers 3*a*, 3*b*, 3*c*, and 3*d*, laser scan units 5*a*, 5*b*, 5*c*, and 5*d*, primary transfer sections 6*a*, 6*b*, 6*c*, and 6*d*, development devices 7*a*, 7*b*, 7*c*, and 7*d*, and cleaners 4*a*, 4*b*, 4*c*, and 4*d* are respectively arranged around the photosensitive drums.

Since image forming operations of the respective colors are common, the operation for yellow will be described as a representative. The electrostatic charger 3*a* applies predetermined voltage to the photosensitive drum 2*a* and electrifies it. The laser scan unit 5*a* has a semiconductor laser as a light source, irradiates the surface of the photosensitive drum 2*a* with a laser beam according to an image signal, and forms an electrostatic latent image. The electrostatic latent image on the photosensitive drum 2*a* is developed by the development device 7*a*, and turns into a toner image. The cleaner 4*a* removes residual toner on the surface of the photosensitive drum 2*a*. The toner images on the photosensitive drums of the respective colors are piled up on an intermediate transfer belt 8 that is an intermediate transfer medium (image bearing member) at the primary transfer sections 6*a* through 6*d* in order.

The intermediate transfer belt 8 is looped around rollers 10, 11, and 21, and rotates in a clockwise direction (predetermined direction) in FIG. 1. The toner images of the respective colors piled up on the intermediate transfer belt 8 are conveyed to a secondary transfer section 22, and are transferred to a sheet S that is conveyed to the secondary transfer section 22 collectively. A cleaner 12 removes residual toner on the intermediate transfer belt 8. The sheet S on which the toner images of the four colors are transferred collectively is conveyed to a fixing device 23. The fixing device 23 thermally fixes the unfixed toner images to the sheet S, and then the sheet S is ejected to a tray 25 through a roller pair 24.

The sheet S is fed to a conveyance path from a cassette 17 or a manual feed tray 13, is corrected in the lateral position by a static-electricity conveyance unit 30, and is conveyed to the secondary transfer section 22 while taking a timing by a registration roller pair 16. A pickup roller 18, a roller pair 19, a longitudinal pass roller pair 20, and the registration roller pair 16 that feed the sheet S from the cassette 17 to the conveyance path are respectively driven with individual stepping motors in order to achieve a fast and stable conveying operation. Similarly, a pickup roller 14 and a roller pair 15 that feed the sheet from the manual feed tray 13 to the conveyance path are respectively driven with individual stepping motors.

Moreover, in double-sided printing, the sheet S that has passed the fixing device 23 is once guided to a double-sided inversion path 27 from the roller pair 24, and then, is inverted and conveyed to a double-sided path 28 in the reverse direction. The sheet S that has passed the double-sided path 28 is again conveyed to the secondary transfer section 22 through the longitudinal pass roller pair 20 in the same way as the above. Toner images of respective colors on the intermediate transfer belt 8 are transferred to the back of the sheet S conveyed to the secondary transfer section 22 collectively. The sheet S to which the images are transferred is ejected to the tray 25 through the fixing device 23 and the roller pair 24.

Figure 4A:
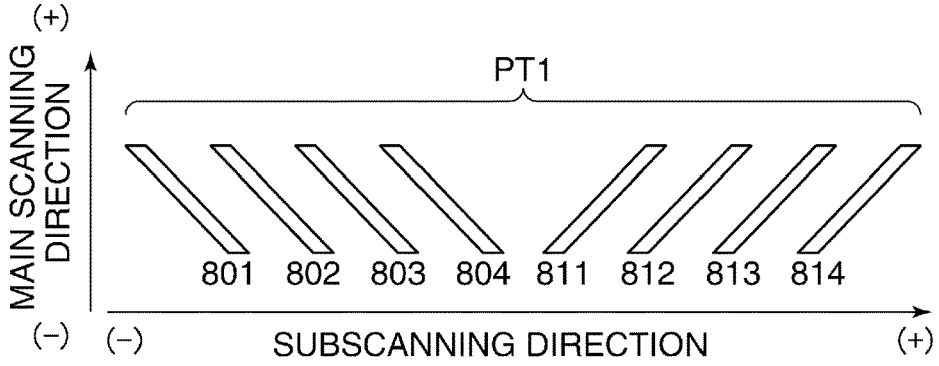
FIG. 4A, FIG. 4B, and FIG. 4C are views respectively showing a pattern image for detecting color registration, a binary signal that is obtained by binarizing a detection signal of the sensor that reads the pattern image, and switching timings of a threshold.

The image forming apparatus 1 has a sensor 40 for detecting color registration. The sensor 40 is arranged at such a position that is opposite to the outer circumferential surface of the intermediate transfer belt 8 to which images are transferred between the photosensitive drum 2*d* and the roller 10. The sensor 40 detects a pattern image PT1 (FIG. 4A) for detecting color registration and another pattern image PT2 (FIG. 5A) for setting thresholds that are transferred to the intermediate transfer belt 8 from the photosensitive drums 2*a*, 2*b*, 2*c*, and 2*d*. A drive timing of the sensor 40 is controlled by a synchronization unit (not shown). The pattern image includes patterns (measurement images) of the toner images of the respective colors and is transferred to the intermediate transfer belt 8.

Figure 2:
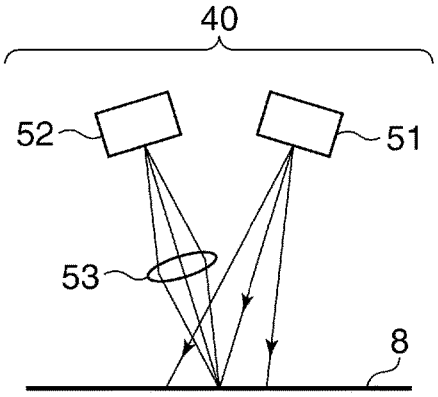
FIG. 2 is a view showing a configuration of a sensor of the image forming apparatus shown in FIG. 1.

FIG. 2 is a view showing the configuration of the sensor 40. The sensor 40 has a light emitting section 51 and a light receiving section 52. The light receiving section 52 detects specular reflection light from a target that is irradiated by the light emitting section 51. The irradiation light from the light emitting section 51 is reflected by the surface (or the pattern image if formed) of the intermediate transfer belt 8. The reflected light is converged with a lens 53 and enters into the light receiving section 52. The light receiving section 52 outputs an output signal on the basis of a light receiving result, and specifically outputs an electrical signal (output signal) of an amplitude corresponding to the received light amount. The output voltage of the light receiving section 52 becomes lower as the reflected light amount decreases, and becomes higher as the light amount increases. That is, the sensor 40 measures the reflected light from the pattern image, and outputs an output value on the basis of the measurement result. Moreover, since a reflectance of the intermediate transfer belt 8 is higher than that of a toner image in general, the output voltage that is a detection result of the reading of the pattern image becomes lower than that of the reading of the intermediate transfer belt 8. As described with reference to FIG. 12A through FIG. 12F, positions of the color patterns in the pattern image are derived by binarizing the output waveform of the sensor 40.

Figure 3:
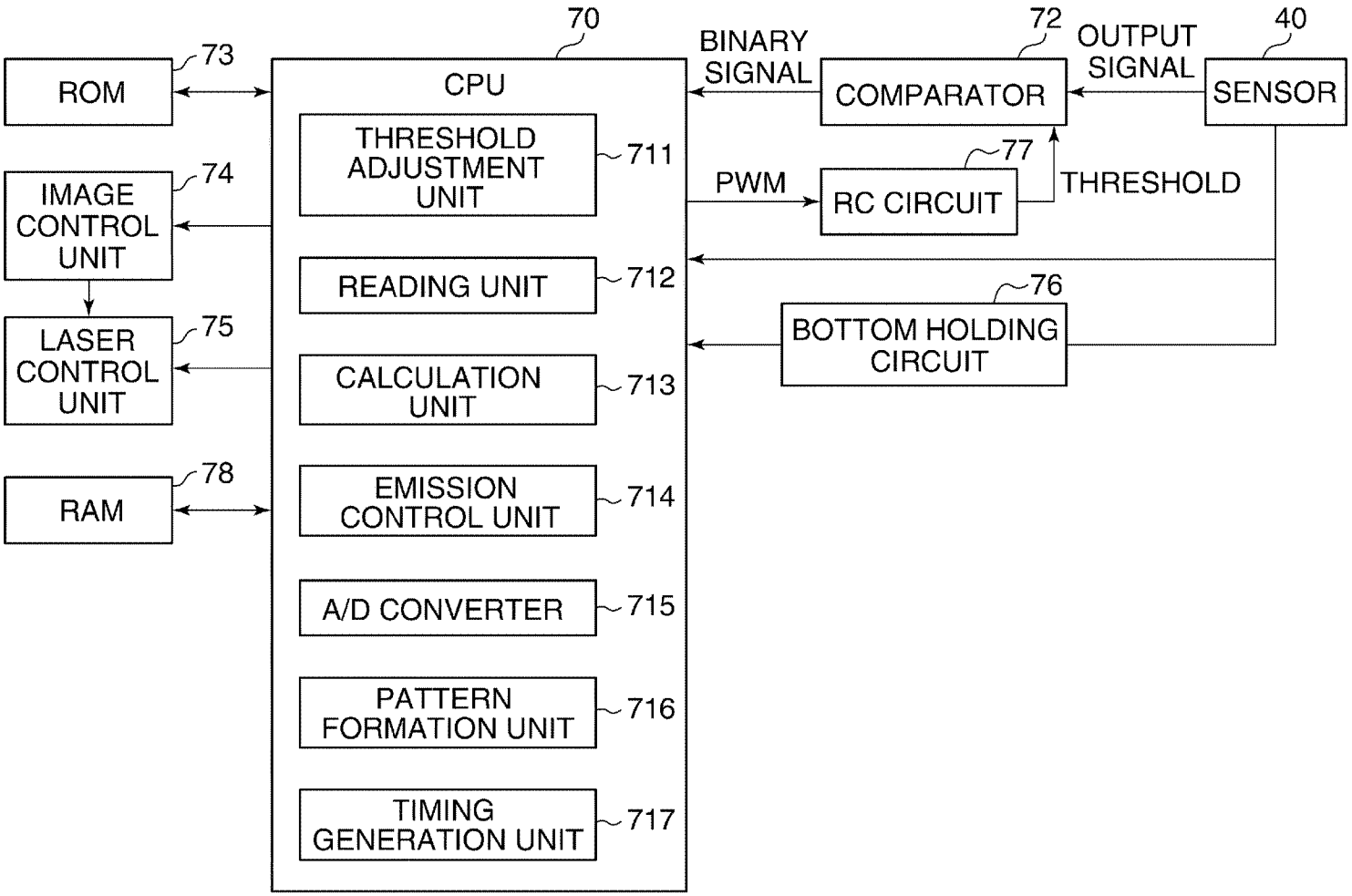
FIG. 3 is a block diagram schematically showing a control system of the image forming apparatus shown in FIG. 1.

FIG. 3 is a block diagram schematically showing a control system of the image forming apparatus 1. The image forming apparatus 1 has a CPU 70 that controls the entire image forming apparatus 1. A RAM 78, a ROM 73, a laser control unit 75, and an image control unit 74 are connected to the CPU 70. The ROM 73 stores a control program that is executed by the CPU 70. The RAM 78 is used as a temporal data saving region. The output signal (sensor output) of the sensor 40 is input into a comparator 72, and is binarized with a threshold that has been set up by the CPU 70 beforehand. The threshold is set up for each color (mentioned later with reference to FIG. 6). An RC circuit 77 generates a signal that indicates the threshold by smoothing a PWM signal output from the CPU 70. The signal (hereinafter referred to as a binary signal) that is binarized with the comparator 72 is input into the CPU 70. The comparator 72 compares the sensor output with the threshold, and obtains the binary signal on the basis of the comparison result.

The CPU 70 is provided with a threshold adjustment unit 711, a reading unit 712, a calculation unit 713, an emission control unit 714, an A/D converter 715, a pattern formation unit 716, and a timing generation unit 717. The threshold adjustment unit 711 adjusts a duty ratio of the PWM signal that generates the threshold used in the comparator 72. The reading unit 712 detects a rising edge and falling edge of the binary signal, and calculates a rising timing and falling timing. The calculation unit 713 calculates a color registration amount from the rising and falling timings calculated by the reading unit 712. A bottom hold circuit 76 is used when the CPU 70 samples the sensor output in a threshold setting process (FIG. 6) mentioned later.

The timing generation unit 717 is used for threshold switching control in a color-registration-amount obtaining process (FIG. 8) mentioned later. The CPU 70 reads information about predetermined period that is a source of switching period T from the ROM 73, and sets it as the switching period T in the timing generation unit 717. The timing generation unit 717 generates a switching timing signal for switching the threshold to a value (a threshold for the following colors) corresponding to the following pattern on the basis of the switching period T that was set and a timing at which level of a binary signal corresponding to a pattern of each color switches. That is, the timing generation unit 717 counts a period from the falling timing (detection of the rear edge of a detection width) of the binary signal, and decides the time point at which the switching period T elapses as the "switching timing" to the threshold corresponding to the following pattern.

The emission control unit 714 controls the emission of the light emitting section 51 of the sensor 40. The A/D converter 715 converts and records an output level of the sensor 40. The pattern formation unit 716 stores pattern image data for forming the pattern image PT1 for detecting color registration and the pattern image PT2 for setting the thresholds. The pattern formation unit 716 sends the pattern image data to the laser control unit 75. The ROM 73 stores the thresholds set to the comparator 72, the color registration amount calculated by the calculation unit 713, the predetermined period ta, the switching period T, and the like.

Figure 4B:
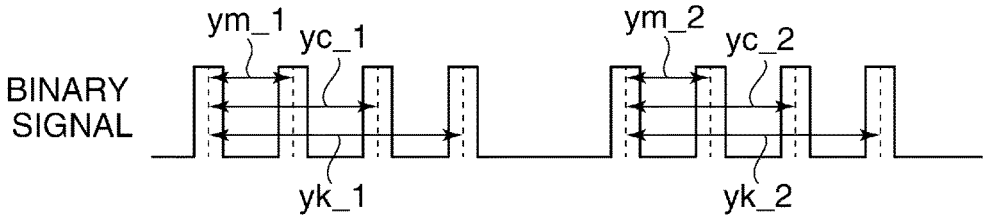
Figure 4C:
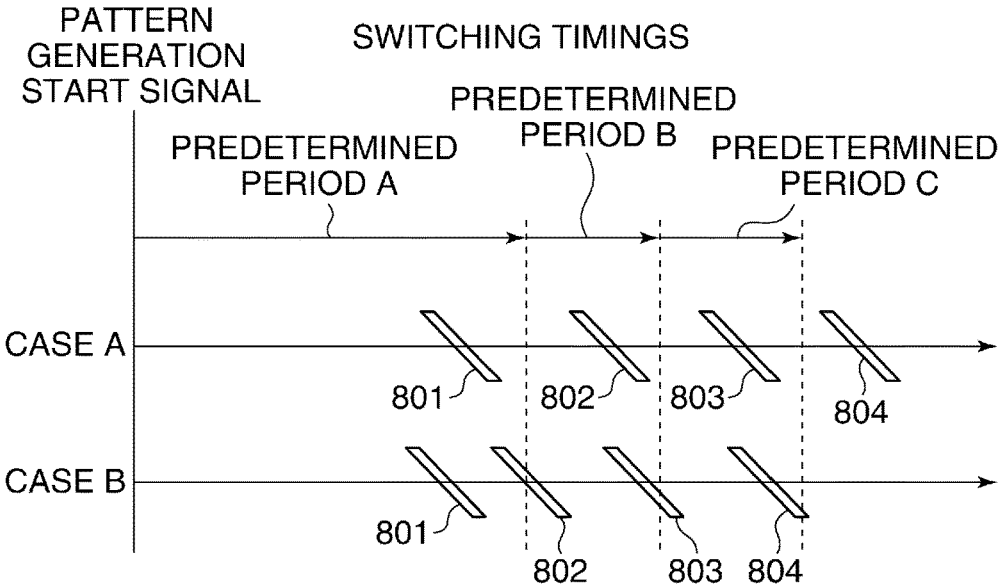

Next, a color registration calculation method by the calculation unit 713 will be described. As shown in FIG. 4B, the color registration amount is calculated from the time periods ym_1, yc_1, and yk_1, and the time periods ym_2, yc_2, and yk_2. The calculation of the color registration amount of magenta will be described as follows. The moving direction of the intermediate transfer belt 8 is defined as a subscanning direction, and the direction (belt-width direction) that intersects perpendicularly with the subscanning direction is defined as a main scanning direction. When the magenta patterns 802 and 812 have color registration in a plus (+) side in the subscanning direction, the values of ym_1 and ym_2 increase by the same amount in proportion to the color registration amount. When the patterns 802 and 812 shift to a minus (−) side in the subscanning direction, the values of ym_1 and ym_2 decrease by the same amount. In the meantime, when the patterns 802 and 812 have the color registration in the plus (+) side in the main scanning direction, the value of ym_1 increases in proportion to the color registration amount, but the value of ym_2 decreases by the same amount. When the patterns 802 and 812 shift to the minus (−) side in the main scanning direction, the value ym_1 decreases and the value of ym_2 increases by the same amount. Accordingly, the color registration Ds in the subscanning direction and the color registration Dm in the main scanning direction are calculated by the following formulas (1) and (2).

$$Ds=X-(ym_1+ym_2)/2S \quad (1)$$

$$Dm=(ym_1-ym_2)/2S \quad (2)$$

In the formula (1), X denotes a value that is obtained by converting the distance between the yellow pattern and the magenta pattern in the subscanning direction into a time period in a case where there is no color registration, and S denotes the conveyance speed (mm/sec). Since the values ym_1 and ym_2 are time periods (sec), they are converted into the distance information using the conveyance speed S of the intermediate transfer belt 8 on which the pattern image PT1 is formed. The formulas (1) and (2) are determined for the color registration of magenta. The color registration amounts of other colors are derived by using the time periods based on the yellow patterns 801 and 811 as standards. It should be noted that patterns of a color other than yellow may be used as standards.

Figure 5A:
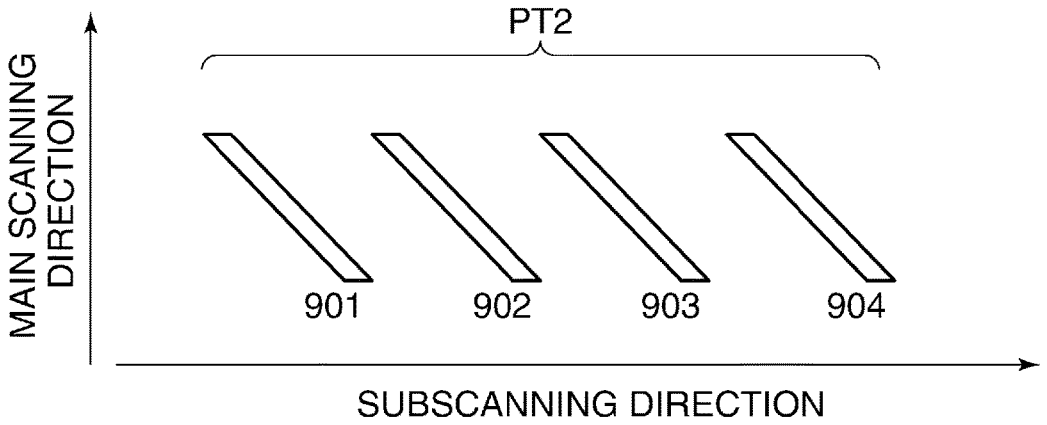
FIG. 5A and FIG. 5B are views respectively showing a pattern image for setting thresholds and the sensor output at the time of detecting the pattern image.
Figure 5B:
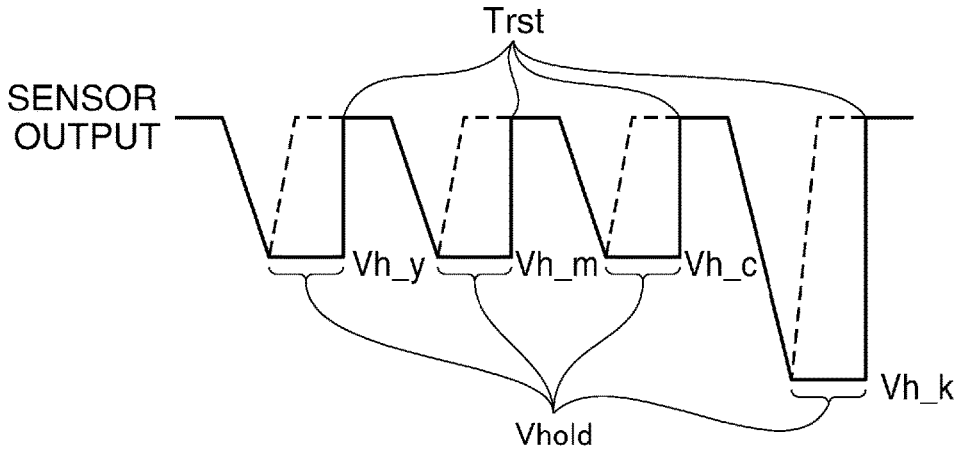

FIG. 5A is a view showing an example of the pattern image PT2 for setting thresholds. FIG. 5B is a view showing the sensor output at the time of detecting the pattern image PT2. The pattern image PT2 consists of a yellow pattern 901, magenta pattern 902, cyan pattern 903, and black pattern 904 as with the pattern image PT1. The pattern of each color is formed so as to be inclined to the main scanning direction at 45 degrees. The intervals (lengths in the subscanning direction) between the patterns of the respective colors in the pattern image PT2 are longer than the intervals between the patterns of the respective colors in the pattern image PT1. This is because the bottom hold circuit 76 needs to sample and hold a sample value of the sensor output (FIG. 5B).

Figure 6:
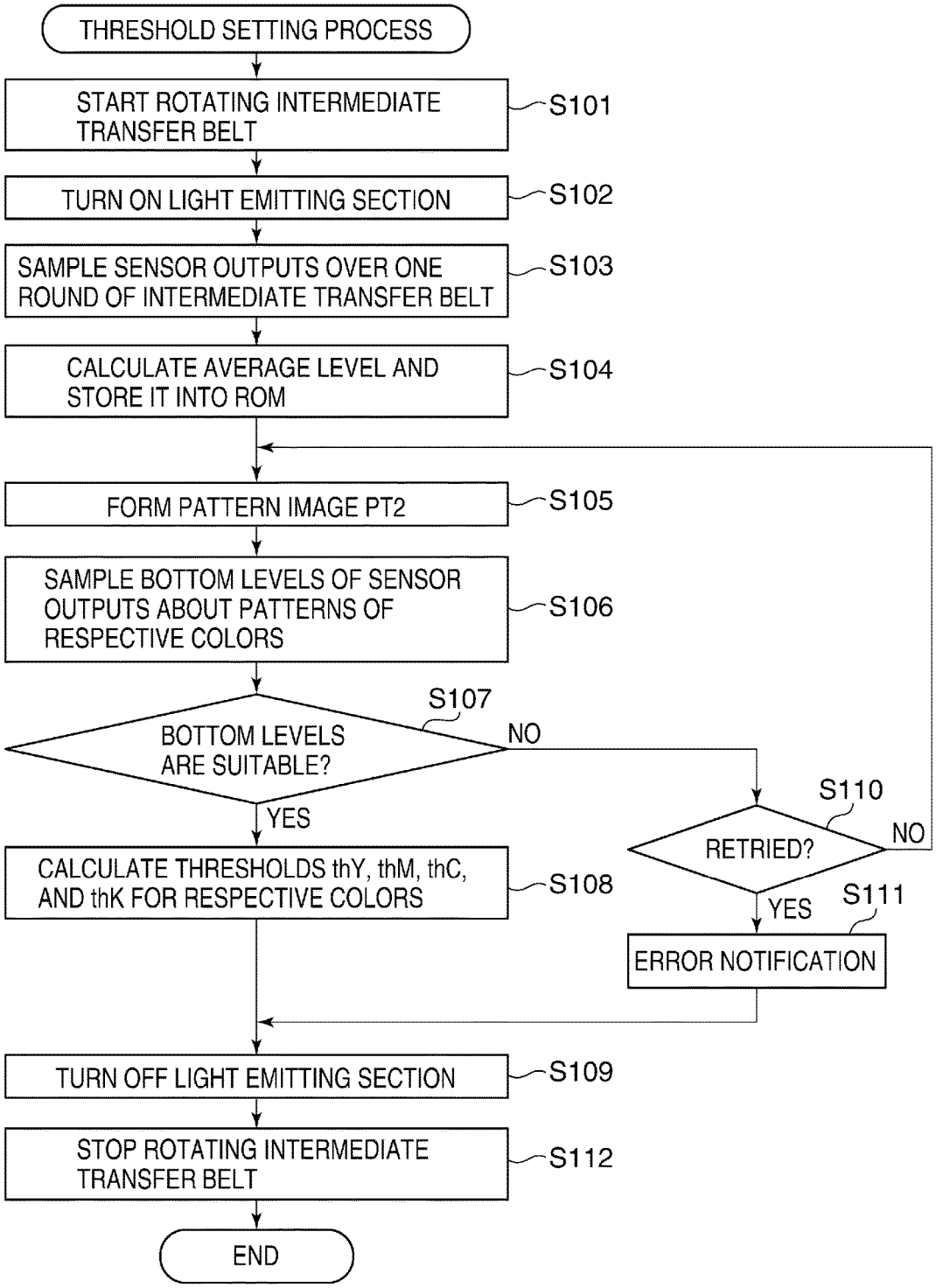
FIG. 6 is a flowchart showing a threshold setting process in the first embodiment.

Next, a process for deciding the thresholds for the respective colors using the pattern image PT2 will be described with reference to FIG. 6. FIG. 6 is a flowchart showing a threshold setting process in the first embodiment. The process in this flowchart is achieved when the CPU 70 reads and runs a program stored in the ROM 73.

The CPU 70 starts rotating the intermediate transfer belt 8 (step S101) first, and controls the light emitting section 51 of the sensor 40 to emit light (step S102). Then, the CPU 70 samples the sensor output of the sensor 40 that receives the reflected light from the intermediate transfer belt 8 on which no toner image is formed for one round of the intermediate transfer belt 8 (step S103). A sampling interval is set to 100 msec, for example. Next, the CPU 70 calculates an average level Base_ave of the obtained sampling data for one round, and stores the value in the ROM 73 (step S104). Next, the CPU 70 controls the four stations IMG-Y, IMG-M, IMG-C, and IMG-K to form the pattern image PT2 on the intermediate transfer belt 8 (step S105).

Then, the CPU 70 samples the bottom levels of the sensor outputs of the sensor 40 for the yellow, magenta, cyan, and black patterns in the pattern image PT2 (step S106). In the samplings, the CPU 70 samples the sensor outputs that are bottom-held by the bottom hold circuit 76 at three times during a period Vhold shown in FIG. 5B at intervals of 5 msec for each color. Then, the CPU 70 stores an average of the three outputs to the ROM 73 as a bottom level of the sensor output of each color. As shown in FIG. 5B, the bottom level of yellow is Vh_y, the bottom level of magenta is Vh_m, the bottom level of cyan is Vh_c, and the bottom level of black is Vh_k. The sensor output currently held is reset at a timing Trst. It should be noted that the sampling frequency of the sensor output that is bottom-held is not limited to three times, but may be one or more times.

Next, the CPU 70 compares the sampled bottom level with the average level Base_ave obtained previously to determine whether the sampled bottom level is a suitable level in step S107. Specifically, the CPU 70 determines whether the difference between the bottom level and the average level Base_ave exceeds a predetermined value. The predetermined value is set up beforehand and saved in the ROM 73. When the above-mentioned difference is not more than the predetermined value, it is determined that the bottom level might not be detected correctly for a reason of a lack of the toner pattern or a crack of the intermediate transfer belt 8 at the position where the sensor 40 detected. In such a case, the CPU 70 determines that the bottom level is not the suitable level, and determines whether a retry has been performed (step S110). Then, when the retry has not been performed, the CPU 70 returns the process to the step S105. In the meantime, when the retry has been performed, an error notification is performed without retrying (step S111), and proceeds with the process to step S109.

When it was determined that the sampled bottom level is the suitable level in the step S107, the threshold adjustment unit 711 of the CPU 70 calculates the thresholds thY, thM, thC, and thK for yellow, magenta, cyan, and black on the basis of the obtained bottom levels of the patterns of the respective colors and the average level Base_ave (step S108). The following formula (3) for calculating the threshold thY for yellow is shown as a representative. The thresholds for the other colors are calculated similarly.

$$thY=(\text{Base_ave}-Vh_y)\alpha+Vh_y \quad (3)$$

Although the value of $\alpha$ is set to 0.5 in this example, it is not limited to 0.5. In a case of $\alpha=0.5$, the value of the midpoint (50%) between the bottom level Vh_y and the average level Base_ave is calculated as the threshold thY using the formula (3). After that, the CPU 70 turns off the light emitting section 51 of the sensor 40 in the step S109, stops rotation of the intermediate transfer belt 8 (step S112), and finishes the process in FIG. 6.

Figure 7:
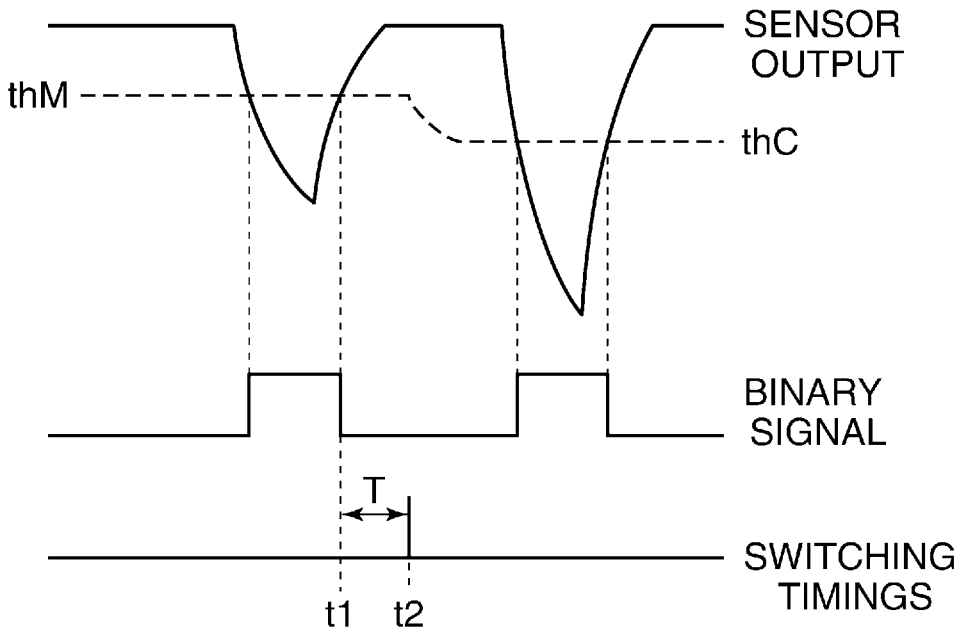
FIG. 7 is a view showing an example of relation between the sensor output and binary signal when the pattern image for detecting the color registration is detected.

Next, examples of the switching timings at which the thresholds used when the sensor 40 detects the patterns of the respective colors of the pattern image PT1 are switched will be described with reference to FIG. 7. FIG. 7 is a view showing an example of relation between the sensor output when the pattern image PT1 for detecting color registration is detected and a binary signal. When the pattern image PT1 is detected, switching timing signals are generated so that the thresholds will switch between the patterns of the respective colors, and it is necessary to switch the thresholds according to the switching timing signals. The CPU 70 switches the threshold level in response to the switching timing signals generated by the timing generation unit 717.

As an example, the CPU 70 reads the predetermined period ta beforehand stored in the ROM 73, and sets it to the timing generation unit 717 as the switching period T. Then, the CPU 70 decides the switching timing at which the switching period T elapsed from a falling (rear edge) of the binary signal corresponding to the pattern to which the threshold preceding switching is applied, and switches the thresholds at the decided switching timing. It should be noted that the predetermined period ta is shorter than the low-level period between the adjacent square waveforms in a case where an ideal symmetrical sensor output waveform is binarized with the threshold of 50%. For example, the predetermined period ta is not more than the half of the low-level period. The low-level period is a period from the falling (rear edge) to rising (front edge) of the binary signal.

In the example shown in FIG. 7, the CPU 70 sets the threshold thM for magenta to the comparator 72, and obtains the binary signal by binarizing the sensor output of the magenta pattern with the threshold thM. Then, the timing generation unit 717 generates the switching timing signal at a time point t2 when the switching period T elapsed from the falling (a time point t1) of the binary signal corresponding to the magenta pattern. The CPU 70 switches the thresholds to the threshold thC for cyan at the time point t2, and obtains the binary signal by binarizing the sensor output of the cyan pattern with the threshold thC. The time point t2 corresponds to the switching timing. It should be noted that two or more sets (for example, ten sets) of the pattern images PT1 are formed and detected. The predetermined threshold thY is set for the yellow pattern in the pattern image PT1 of the first set that is detected first at the time of starting the formation of the pattern image PT1 of the first set. The thresholds may be switched to the threshold thY for the yellow pattern in the pattern image PT1 of the second or later set on the basis of the falling of the binary signal corresponding to the black pattern in the pattern image PT1 of the previous set.

It should be noted that the CPU 70 calculates the color registration amount from the binary signal generated in this way using the formulas (1) and (2). After that, the CPU 70 corrects the color registration by changing an image forming condition on the basis of the calculated color registration amount. For example, the CPU 70 adjusts exposure timings of the respective colors on the basis of the color registration amount in order to correct relative positional shift between the respective color images. This adjusts the image forming positions of the respective color images. Since the method for correcting the color registration is well-known, a detailed description is omitted. A detailed process for obtaining the color registration amount will be described with reference to FIG. 8.

Figure 8:
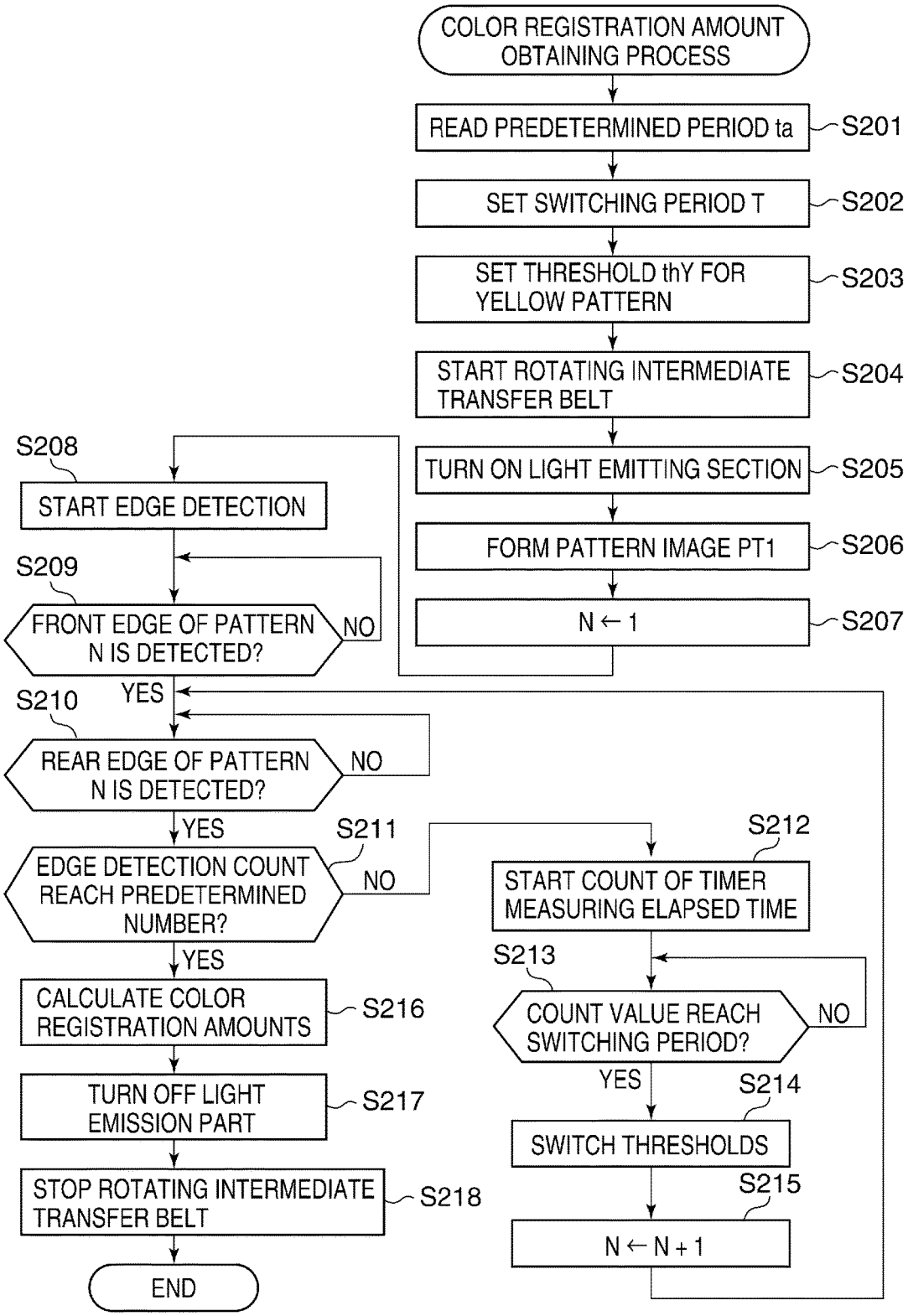
FIG. 8 is a flowchart showing a color-registration-amount obtaining process in the first embodiment.

FIG. 8 is a flowchart showing a color-registration-amount obtaining process in the first embodiment. The process in this flowchart is achieved when the CPU 70 reads and runs a program stored in the ROM 73. This process is started when the main power supply of the image forming apparatus 1 is turned on or when the number of images that have been formed by the image forming apparatus 1 is not less than a predetermined number after the color-registration-amount obtaining process was executed last time. It should be noted that the start condition of the threshold setting process shown in FIG. 6 is the same as this. For example, when the main power is turned on, the CPU 70 executes the threshold setting process shown in FIG. 6 in advance, and executes the color-registration-amount obtaining process shown in FIG. 8 after that.

The CPU 70 first reads the predetermined period ta from the ROM 73 (step S201), and sets the predetermined period ta to the timing generation unit 717 as the switching period T (step S202). Next, the CPU 70 sets the threshold thY for the yellow pattern that is the first detection target in the pattern image PT1 from among the thresholds obtained in the threshold setting process (FIG. 6) as the threshold used for binarization (step S203). After that, the CPU 70 controls to start rotation of the intermediate transfer belt 8 (step S204) and controls the light emitting section 51 of the sensor 40 to emit light (step S205). Next, the CPU 70 controls the stations IMG-Y, IMG-M, IMG-C, and IMG-K to form the pattern image PT1 on the intermediate transfer belt 8 (step S206) and sets a counter N for grasping the order of respective color patterns to "1" as an initial value (step S207).

Next, the CPU 70 starts to detect edges of the binary signal. Namely, the CPU 70 starts to detect a rising (front edge) and falling (rear edge) of the signal that is obtained by binarizing the output of the sensor 40 by the comparator 72 (step S208). In the description, a pattern about which a sensor output is subjected to the binarization is referred to as a pattern N. The first pattern N is a yellow pattern. The CPU 70 waits until a front edge of the pattern N will be detected (step S209). When the front edge is detected, the CPU 70 waits until a rear edge of the pattern N will be detected (step S210). When the rear edge of the pattern N is detected, the CPU 70 determines whether the number of detected edges that is a total of the detection counts of the front edges and rear edges from an edge detection start reached a predetermined number (step S211). In the description, the predetermined number is a total of the edges detected when the respective color patterns of all the pattern images PT1 are detected correctly. For example, since the single pattern image PT1 generates 16 edges, the predetermined number is 160 when ten sets of the pattern images PT1 is formed.

As a result of the determination in the step S211, when the number of detected edges has not reached the predetermined number, the CPU 70 starts counting a timer that measures elapsed time from the timing of detecting the rear edge in the previous step S210 (step S212). Then, the CPU 70 waits until a count value of the timer that indicates the elapsed time reaches the switching period T (step S213). When the count value reaches the switching period T, the CPU 70 proceeds with the process to step S214. In step the S214, the CPU 70 (the timing generation unit 717) generates a switching timing signal, and the CPU 70 switches the current threshold to a threshold for the following pattern in order to detect the following pattern (pattern N+1). For example, the threshold thY for the head yellow pattern is set up at the start of the sequence for obtaining color registration. When a front edge and rear edge are detected after that, the timing at which the switching period T elapses from the detection of the rear edge becomes the switching timing of thresholds. The CPU 70 switches the threshold thY to the threshold thM for the magenta pattern that is the following target at the switching timing. A threshold for comparing with an output value about a first color pattern in the pattern image shall be a first threshold. A threshold for comparing with an output value about a second color pattern following the first color pattern in the rotational direction of the intermediate transfer belt 8 shall be a second threshold. The CPU 70 corresponds to the controller that controls the timing at which the first threshold is changed to the second threshold in the present invention.

After that, the CPU 70 increments the counter N (step S215), returns the process to the step S210, and continues detection of edges. In the meantime, as a result of the determination in the step S211, when the number of detected edges reached the predetermined number, the CPU 70 calculates the color registration amount using the formulas (1) and (2) because all the patterns of all the pattern images PT1 have been detected (step S216), Since the plurality of pattern images PT1 are formed, the CPU 70 obtains (decides) the value that is obtained by averaging the color registration amounts deduced from the respective pattern images PT1 as the final color registration amount. This increases accuracy. Furthermore, at least one pattern image PT1 is enough from a viewpoint of simplification of the configuration. After that, the CPU 70 turns off the light emitting section 51 of the sensor 40 (step S217), stops the rotation of the intermediate transfer belt 8 (step S218), and finishes the process in FIG. 8.

According to the first embodiment, the CPU 70 decides the switching timing to the threshold corresponding to the following pattern on the basis of the timing (rear edge) at which the level of the binary signal is changed corresponding to the respective color patterns in the pattern image PT1. Then, when the sensor output corresponding to the following pattern is binarized, the CPU 70 switches thresholds to the threshold for the following pattern at the decided switching timing. Thereby, the thresholds used for binarizing the sensor outputs corresponding to the respective color patterns in the pattern image (i.e., the thresholds for deciding the color registration amount from the pattern image) are switched at the suitable timings. Accordingly, since switching to the threshold for the following pattern does not become too late or too early, the binarization is performed using a suitable threshold, which enables correct detections of the respective color patterns. As a result, the color registration amount is obtained appropriately and the color-registration-correction accuracy is not deteriorated.

Moreover, the reference for determining the switching timing is the falling timing (rear edge) of the level of the binary signal and the switching period T is decided on the basis of the predetermined period Ta. These certainly generate the switching timing in the low-level period of the binary signal corresponding to an adjacent pattern. It should be noted that the standard for deciding the switching timing may be the rising timing (front edge) of the level of the binary signal. In such a case, the predetermined period Ta may be set in consideration of an assumed high-level period (detection width) of a square waveform of a binary signal.

Moreover, since the thresholds are set up using the pattern image PT2 of which the pattern interval is larger than that of the pattern image PT1 used for detecting color registration, the thresholds for the respective color patterns are set up with high accuracy. It should be noted that the pattern image PT1 used for detecting color registration may be used for setting the thresholds (FIG. 6).

Although the predetermined period to shall be common to the respective colors, the present invention is not limited to this. Different values corresponding to the respective colors may be stored in the ROM 73 as the predetermined periods.

Next, an image forming apparatus according to a second embodiment of the present invention will be described. In the first embodiment, the timing at which the fixed switching period T elapses from the falling timing (rear edge) of the level of the binary signal becomes the switching timing. On the other hand, in a second embodiment of the present invention, the switching period T is decided for each color. The second embodiment will be described using FIG. 10 in place of FIG. 6, and further using FIG. 9 and FIG. 11. The other configurations are the same as that of the first embodiment.

Figure 9A:
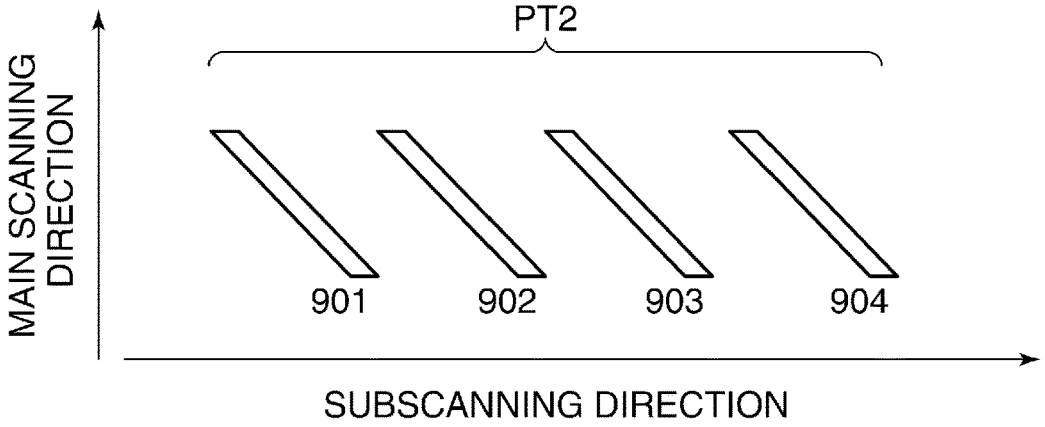
FIG. 9A and FIG. 9B are views respectively showing the pattern image for setting the thresholds and an example of relation between the sensor output and binary signal when the pattern image is detected.
Figure 9B:
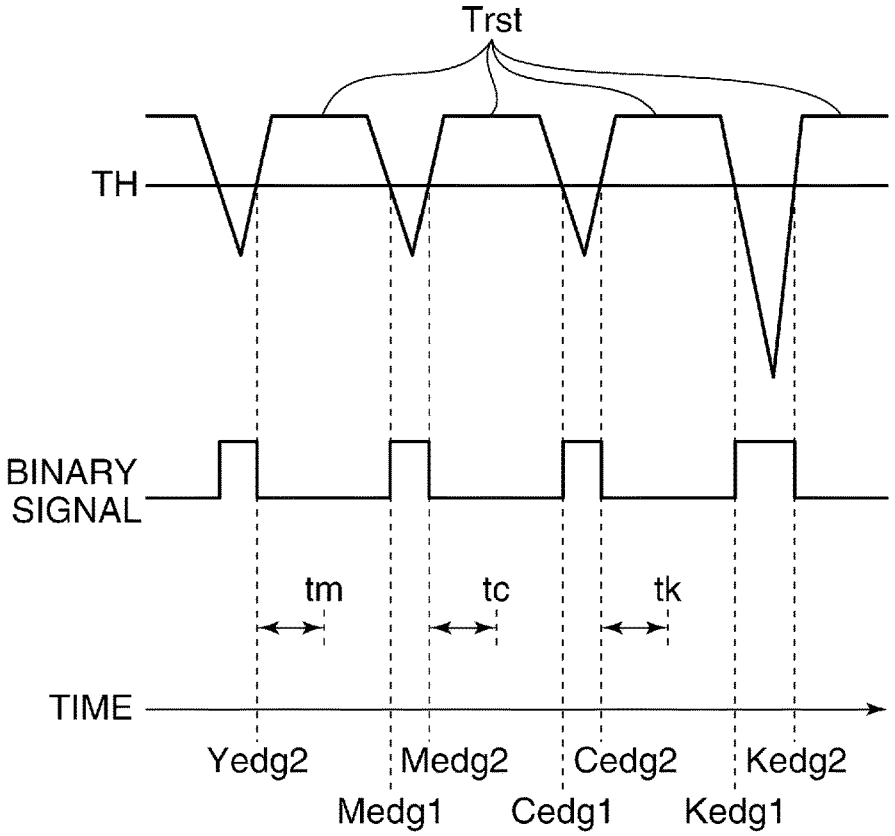

FIG. 9A is a view showing an example of a pattern image PT2 for setting thresholds. FIG. 9B is a view showing an example of relation between a sensor output and binary signal when the pattern image PT2 is detected. The sensor output is binarized with a predetermined threshold TH. As shown in FIG. 9B, a timing of the falling edge of the binary signal corresponding to a yellow pattern shall be Yedg2. Timings of a rising edge and falling edge of the binary signal corresponding to a magenta pattern shall be Medg1 and Medg2, respectively. Timings of rising edges and falling edges of the binary signal corresponding to cyan and black patterns shall be Cedg1, Cedg2, Kedg1, and Kedg2, respectively.

The CPU 70 obtains the timings of the respective edges and finds the period between adjacent edges across a low-level binary signal as a switching setting value. That is, the CPU 70 finds the period from the timing Yedg2 as a start point to a midpoint between the timings Yedg2 and Medg1 as a switching setting value tm with a formula (4) mentioned below. Similarly, the CPU 70 finds the period from the timing Medg2 as a start point to a midpoint between the timings Medg2 and Cedg1 as a switching setting value tc with a formula (5) mentioned below. The CPU 70 finds the period from the timing Cedg2 as a start point to a midpoint between the timings Cedg2 and Kedg1 as a switching setting value tk with a formula 6 mentioned below.

$$tm=(M\text{edg}1-Y\text{edg}2)/2 \quad (4)$$

$$tc=(C\text{edg}1-M\text{edg}2)/2 \quad (5)$$

$$tk=(K\text{edg}1-C\text{edg}2)/2 \quad (6)$$

The CPU 70 sets the switching setting values corresponding to the respective colors to the switching set period T when detecting the color registration. It should be noted that the switching period T for the yellow pattern in the pattern image PT1 that is detected secondary may be set to a predetermined value (for example, the value to described in the first embodiment), or may be set to the value tm, tc, or tk. It should be noted that there is no need to find the switching setting value for the yellow pattern in the pattern image PT1 that is detected first as with the first embodiment because the threshold thY is set when the formation of the first pattern image PT1 is started. Since the high-level period is divided by 2 in each of the formulas (4), (5), and (6), the switching setting value is equivalent to a half of the high-level period. It should be noted that the CPU 70 may decide a predetermined ratio of the high-level period as the switching setting value in the range less than 100%.

Figure 10:
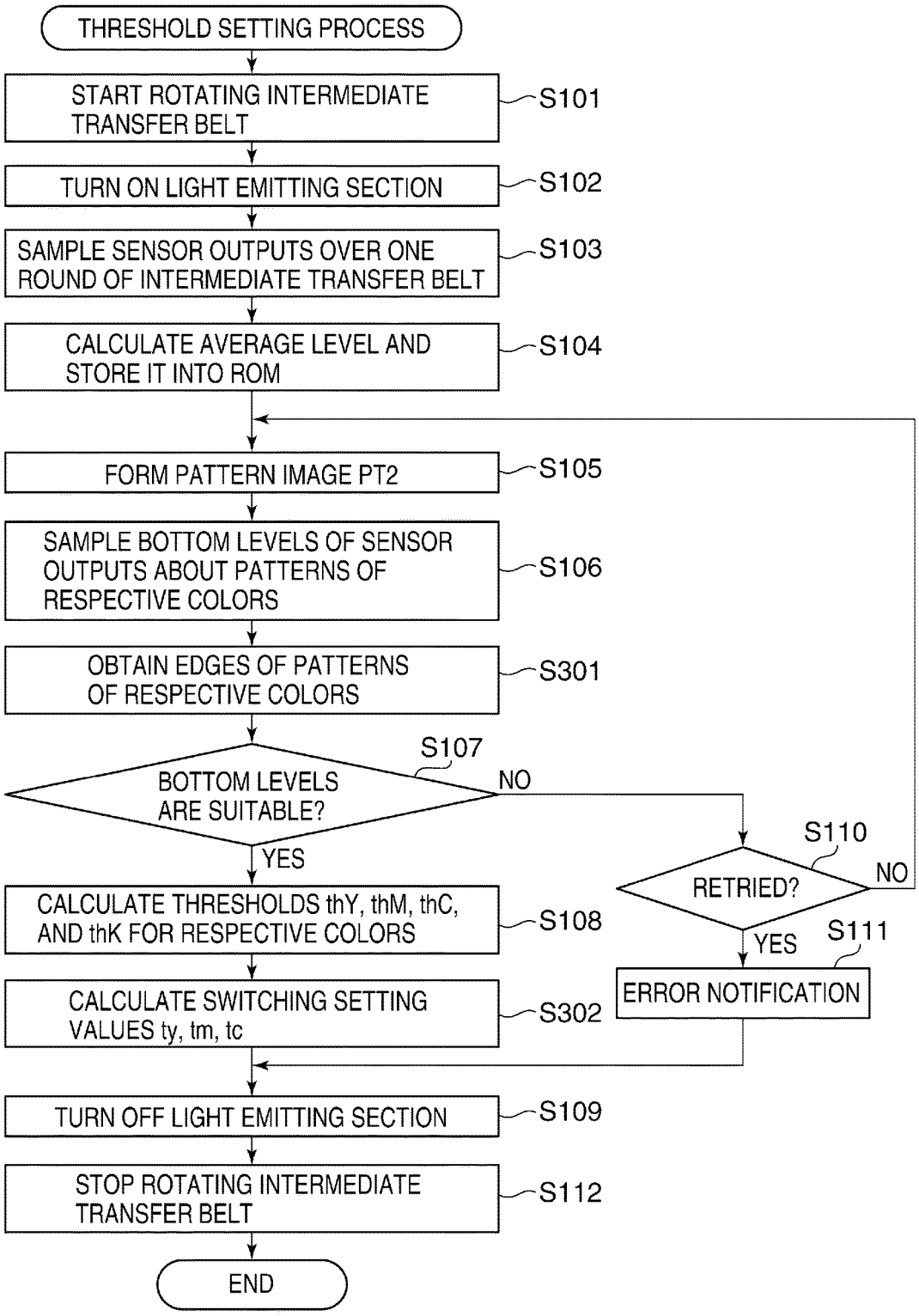
FIG. 10 is a flowchart showing a threshold setting process in a second embodiment.

FIG. 10 is a flowchart showing a threshold setting process in the second embodiment. The process in this flowchart is achieved when the CPU 70 reads and runs a program stored in the ROM 73. As shown in FIG. 10, the steps other than steps S301 and S302 are the same as the steps descried in FIG. 6. After executing the step S106, the CPU 70 obtains the rising edges and falling edges of the binary signals corresponding to the respective color patterns in the step S301, and proceeds with the process to the step S107. After executing the step S108, the CPU 70 calculates the switching setting values tm, tc, and tk using the formulas (4), (5), and (6), and proceeds with the process to the step S109.

Figure 11:
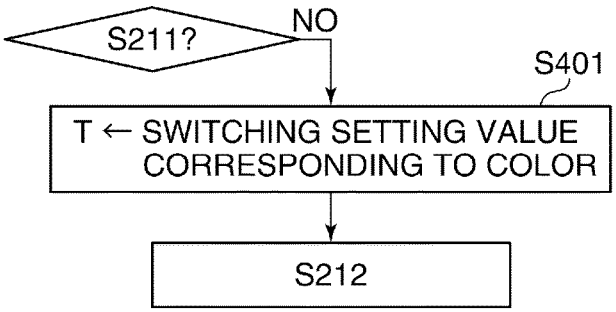
FIG. 11 is a flowchart showing a part of a color-registration-amount obtaining process in the second embodiment.
Figure 12A:
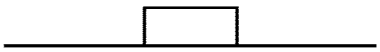
FIG. 12A and FIG. 12D are views showing patterns for detecting color registration formed on an intermediate transfer belt viewed in a horizontal direction.
Figure 12D:
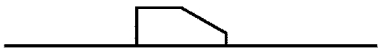
Figure 12B:
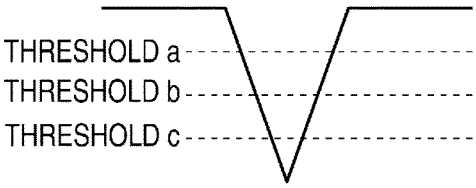
FIG. 12B and FIG. 12E are views respectively showing output signals (sensor outputs) of a color registration sensor when reading the patterns in FIG. 12A and FIG. 12D.
Figure 12E:
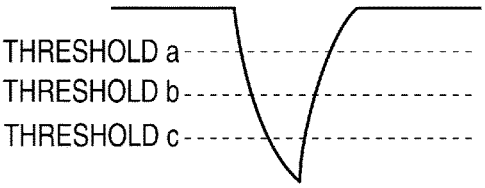
Figure 12C:
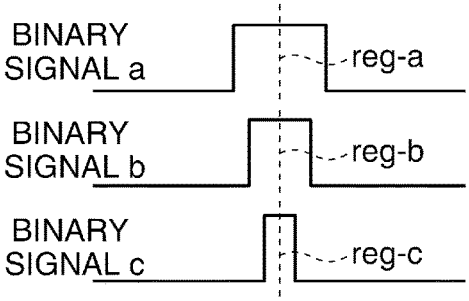
FIG. 12C and FIG. 12F are views respectively showing binary signals that are obtained by binarizing the sensor outputs shown in FIG. 12B and FIG. 12E with different thresholds.
Figure 12F:
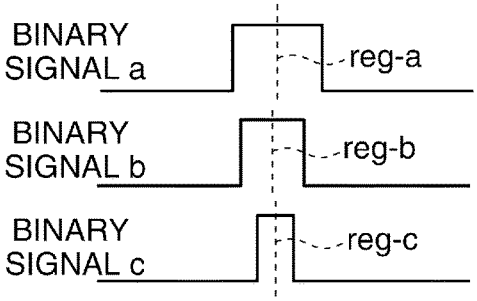

FIG. 11 is a flowchart showing a part of a color-registration-amount obtaining process in the second embodiment. Since the steps previous to the step S211 and the steps following the step S212 are the same as that shown in FIG. 8, illustration of these steps is omitted. As a result of the determination in the step S211, when the number of detected edges has not reached the predetermined number, the CPU 70 sets the switching setting value corresponding to the pattern that is the following target as the switching period T in step S401. For example, when the following detection target is the magenta pattern, the switching setting value tm is set to the switching period T. Then, the CPU 70 proceeds with the process to the step S212. Thereby, the timing at which the switching period T set up for each color elapses is decided as the switching timing in the step S213.

According to the second embodiment, the same effect as the first embodiment is obtained about the switching of the thresholds for determining the color registration amount from the pattern image at the suitable timing.

Moreover, the CPU 70 decides the period equivalent to the predetermined ratio of the time interval (high level period) between the falling of the level of the binary signal corresponding to one color pattern in the pattern image PT2 and the rising of the level of the binary signal corresponding to the following pattern as the switching period T. Accordingly, the thresholds are switched at the timings that are suitable for the respective colors.

Moreover, since the threshold setting process in FIG. 10 performs the setting of the thresholds for the respective colors together with the obtaining of the switching setting values for the respective colors using the pattern image PT2, the process is quick.

It should be noted that the method for setting the thresholds for the respective color patterns is not limited to the exemplified method in the above-mentioned embodiments. Moreover, the sensor output when the reflected light from the intermediate transfer belt 8 is measured is larger than the sensor output when the reflected light from a pattern is measured in the first and second embodiments. However, the apparatus may be configured so that the sensor output when the reflected light from the intermediate transfer belt 8 is measured will be smaller than the sensor output when the reflected light from a pattern is measured. In such a configuration, a binary signal becomes low level when the sensor output is smaller than a threshold and the binary signal becomes high level when the sensor output is larger than the threshold.

Other Embodiments

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

The present invention includes various configurations as long as they do not deviate from the point of the present invention. Parts of the above-mentioned embodiments may be combined suitably.

This application claims the benefit of Japanese Patent Application No. 2017-131192, filed Jul. 4, 2017, which is hereby incorporated by reference herein in its entirety.

What is claimed is:

1. An image forming apparatus that forms an image on a sheet, the apparatus comprising:

an image bearing member configured to rotate;

a plurality of image forming units configured to form color images, each having a different color, on the image bearing member;

a sensor configured to detect color patterns formed on the image bearing member by the plurality of image forming units, the color patterns being used for detecting color registration;

a comparator configured to compare a detection value corresponding to a detection result by the sensor with a threshold, and to output an output value according to a comparison result; and a controller configured to control the plurality of image forming units to form color patterns, to control the sensor to detect the color patterns, to set the thresholds that correspond to the color patterns, to control the color registration according to the output value from the comparator, wherein the color patterns include a first color pattern of first color and a second color pattern of second color that is different from the first color, wherein the second color pattern is formed at an upstream side of the first color pattern in a rotational direction of the image bearing member, wherein the first color pattern is adjacent to the second color pattern, wherein the controller sets the threshold to a second threshold that corresponds to the second color pattern based on an edge timing of the output value that is output from the comparator according to the comparison result between the detection value corresponding to a detection result about the first color pattern and a first threshold corresponding to the first color pattern.

2. The image forming apparatus according to claim 1, wherein the controller sets the threshold to the second threshold when a predetermined period elapses from the edge timing.

3. The image forming apparatus according to claim 1, wherein the output value includes a rising edge timing and a falling edge timing, and wherein the controller sets the threshold to the second threshold when a predetermined period elapses from the falling edge timing.

4. The image forming apparatus according to claim 1, wherein the output value includes a rising edge timing and a falling edge timing, and wherein the controller sets the threshold to the second threshold when a predetermined period elapses from the rising edge timing.

5. The image forming apparatus according to claim 1, wherein the output value varies from a first value to a second value after the first color pattern reaches a detection position of the sensor, wherein the output value varies from the second value to the first value before the first color pattern passes the detection position, and wherein the edge timing corresponds to a timing at which the output value output from the comparator based on the comparison result between the detection value and the first threshold varies from the second value to the first value.

6. The image forming apparatus according to claim 1, wherein the output value varies from a first value to a second value after the first color pattern reaches a detection position of the sensor, wherein the output value varies from the second value to the first value before the first color pattern passes the detection position, and wherein the edge timing corresponds to a timing at which the output value output from the comparator based on the comparison result between the detection value and the first threshold varies from the first value to the second value.

7. The image forming apparatus according to claim 1, wherein the output value becomes a first value in a case where the detection value is more than the threshold, wherein the output value becomes a second value that is different from the first value in a case where the detection value is less than the threshold, and wherein the edge timing corresponds to a timing at which the output value output from the comparator based on the comparison result between the detection value and the first threshold varies from the second value to the first value.

8. The image forming apparatus according to claim 1, wherein the output value becomes a first value in a case where the detection value is less than the threshold, wherein the output value becomes a second value that is different from the first value in a case where the detection value is more than the threshold, and wherein the edge timing corresponds to a timing at which the output value output from the comparator based on the comparison result between the detection value and the first threshold varies from the second value to the first value.

9. The image forming apparatus according to claim 1, wherein the output value becomes a first value in a case where the detection value is more than the threshold, wherein the output value becomes a second value that is different from the first value in a case where the detection value is less than the threshold, and wherein the edge timing corresponds to a timing at which the output value output from the comparator based on the comparison result between the detection value and the first threshold varies from the first value to the second value.

10. The image forming apparatus according to claim 1, wherein the output value becomes a first value in a case where the detection value is less than the threshold, wherein the output value becomes a second value that is different from the first value in a case where the detection value is more than the threshold, and wherein the edge timing corresponds to a timing at which the output value output from the comparator based on the comparison result between the detection value and the first threshold varies from the first value to the second value.

11. The image forming apparatus according to claim 1, wherein the controller controls the plurality of image forming units to form predetermined color patterns, each having a different color, controls the sensor to detect the predetermined color patterns, and decides the first threshold and the second threshold according to a detection value corresponding to a detection result of the predetermined color patterns by the sensor.

12. The image forming apparatus according to claim 11, wherein the interval of the predetermined color patterns is larger than the interval of the color patterns.

13. The image forming apparatus according to claim 1, wherein the sensor measures reflected light from the image bearing member to detect the color patterns on the image bearing member.

14. The image forming apparatus according to claim 1, further comprising an RC circuit configured to control the threshold based on a pulse signal, and wherein the controller controls frequency of the pulse signal to control the threshold.

15. The image forming apparatus according to claim 1, wherein the controller controls the color registration so that the relative position of the image of the reference color which should be formed with the plurality of image forming units, and the image of other colors which should be formed with the plurality of image forming units is corrected.

* * * * *